US006886434B2

(12) United States Patent
Hu

(10) Patent No.: US 6,886,434 B2
(45) Date of Patent: May 3, 2005

(54) WRENCH WITH A FIXED MAXIMUM OPERATIONAL TORQUE

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 135 days.

(21) Appl. No.: 10/444,026

(22) Filed: May 22, 2003

(65) Prior Publication Data

US 2003/0221524 A1 Dec. 4, 2003

(30) Foreign Application Priority Data

Jun. 3, 2002 (TW) ..... 91112047 A

(51) Int. Cl.[7] ..... B25B 23/14

(52) U.S. Cl. ..... 81/467; 81/478; 81/480; 81/481; 81/483; 464/35; 464/37; 464/41

(58) Field of Search ..... 81/467, 478, 480, 81/481, 483; 464/35, 37, 41

(56) References Cited

U.S. PATENT DOCUMENTS

| | | | | | |
|---|---|---|---|---|---|
| 2,157,574 | A | | 5/1939 | Siesel | 464/35 |
| 2,300,652 | A | | 11/1942 | Cooney | 81/483 |
| 2,332,971 | A | | 10/1943 | Johnson | 81/480 |
| 2,396,027 | A | | 3/1946 | Spayd | 81/480 |
| 2,601,044 | A | | 6/1952 | Mayer | 81/480 |
| 2,768,547 | A | | 10/1956 | Noell | 81/480 |
| 2,826,107 | A | | 3/1958 | Woods | 81/480 |
| 2,924,134 | A | * | 2/1960 | Harmes | 81/467 |
| 2,972,271 | A | | 2/1961 | Gill | 81/480 |
| 3,593,542 | A | | 7/1971 | Urayama | 464/37 |
| 3,651,718 | A | | 3/1972 | Thomasian | 81/480 |
| 3,958,469 | A | * | 5/1976 | Meese | 81/58.3 |
| 4,238,978 | A | * | 12/1980 | Leone | 81/480 |
| 4,308,770 | A | | 1/1982 | MacDonald | 81/177.2 |
| 5,152,200 | A | | 10/1992 | Kaplan | 81/467 |
| 5,643,089 | A | * | 7/1997 | Hummel | 464/37 |
| 5,822,830 | A | | 10/1998 | Lin | 16/422 |
| 6,029,551 | A | | 2/2000 | Wu | 81/475 |
| 6,076,439 | A | | 6/2000 | Dzieman | 81/473 |
| 6,155,147 | A | | 12/2000 | Dzieman | 81/473 |
| 6,439,086 | B1 | * | 8/2002 | Bahr | 81/467 |
| 6,487,943 | B1 | | 12/2002 | Jansson et al. | 81/475 |
| 6,502,483 | B1 | | 1/2003 | Swank et al. | 81/437 |
| 6,666,117 | B2 | | 12/2003 | Hu | 81/467 |
| 2003/0010162 | A1 | | 1/2003 | Hu | |
| 2003/0010163 | A1 | | 1/2003 | Hu | |
| 2003/0079577 | A1 | | 5/2003 | Hu | |
| 2003/0079578 | A1 | | 5/2003 | Hu | |
| 2003/0079579 | A1 | | 5/2003 | Hu | |
| 2003/0205114 | A1 | | 11/2003 | Hu | |
| 2003/0205115 | A1 | | 11/2003 | Hu | |

* cited by examiner

*Primary Examiner*—Lee D. Wilson
*Assistant Examiner*—Alvin J Grant
(74) *Attorney, Agent, or Firm*—Alan D. Kamrath; Nikolai & Mersereau, P.A.

(57) ABSTRACT

A wrench includes a drive member for driving a fastener, a retainer securely engaged with the drive member to move therewith, and a casing having a compartment for accommodating the retainer. The casing includes a retaining section defining a retaining space for retaining the retainer in place. When a rotational force applied to the casing is smaller than an engaging force between the retaining section of the casing and a retaining device that is attached between the retaining section and the retainer, the retainer and the rod are turned to thereby turn the fastener. When a rotational force applied to the casing is greater than the engaging force, the casing slides while the retainer and the rod are not turned. The drive member is releasably engaged with the retainer, allowing the wrench to be used with various types of drive members for driving various types of fasteners.

20 Claims, 15 Drawing Sheets

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to an object secured by a fastener driven by the wrench.

2. Description of the Related Art

FIG. 13 of the drawings illustrates a conventional wrench 1 having a hexagonal driving portion with six planar faces 2 for engaging with six faces of a hexagonal groove in a top face of a fastener. However, slide tends to occur between the planar faces of the driving portion of the wrench 1 and the faces of the fastener. FIG. 14 illustrates a so-called TORX wrench 3 having plural arcuate faces 4 for engaging with respective arcuate faces in a top face of a fastener. Such a TORX wrench 3 is used to tighten important parts of a car and cutting tools. As illustrated in FIG. 15, a blade 7 is tightened to a cutting tool 5 by a bolt 6. However, it was found that the expensive blade 7 tends to be damaged when the bolt 6 is excessively tightened. But the blade 7 could fly away and thus cause injury if the bolt 6 is not tightened to the desired extent.

Taiwan Utility Model Publication No. 266533 discloses a wrench including a tubular member, a sounding means mounted in an intermediate portion of the tubular member, and a torque-setting means attached to a rear end of the tubular member. The torque-setting means includes a tube mounted around the rear end of the tubular member, and marks are provided on the tubular member for indicating the maximum torque value applied by the wrench. The maximum torque value of the wrench is set by means of turning the tube of the torque-setting means, which causes a change in the compressed extent of the elastic element and thus changes the force pressing against the sounding means, and the value is indicated by the marks on the tubular member. When the torque applied by the user to a fastener to be tightened is greater than the predetermined maximum torque value, the sounding means sounds, indicating that the fastener has already been tightened. However, the overall volume of the wrench is too large to be used in a small space. Further, the wrench cannot be used to drive fasteners of various types.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener is prevented.

Another object of the present invention is to provide a wrench with a fixed maximum operational torque that can be altered in response to the actual use.

A further object of the present invention is to provide a wrench with a fixed maximum operational torque that can be used with various types of drive members for driving various types of fasteners.

In accordance with a first aspect of the invention, a wrench comprises:

a casing including a compartment, the casing further including a retaining section defining a retaining space;

a retainer pivotably received in the compartment of the casing and having a first end and a second end;

a drive member releasably and securely engaged with the retainer to move therewith, the drive member having a driving portion on an end thereof that is located outside the casing for engaging with a fastener; and retaining means for retaining the retainer in place, the retaining means having a first portion attached to the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

In accordance with a second aspect of the invention, a wrench comprises:

a casing including a compartment, the casing further including a retaining section defining a retaining space;

a retainer received in the compartment of the casing and having a first end and a second end, the retainer being pivotally movable in the compartment about the first end of the retainer;

a drive member securely engaged with the retainer to move therewith, the drive member having a driving portion on an end thereof that is located outside the casing for engaging with a fastener, the drive member being disengageable from the retainer by means of directly pulling the drive member away from the casing along a longitudinal axis of the drive member; and a retaining means for retaining the retainer in place, the retaining means having a first portion attached to the second end of the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

In accordance with a third aspect of the invention, a wrench comprises:

a casing including a compartment, the casing further including a retaining section defining a retaining space;

a retainer received in the compartment of the casing and having two ends, the retainer being pivotally movable in the compartment about a center of the retainer;

a drive member securely engaged with the retainer to move therewith, the drive member having a driving portion on an end thereof that is located outside the casing for engaging with a fastener, the drive member being disengageable from the retainer by means of directly pulling the drive member away from the casing along a longitudinal axis of the drive member; and two retaining means for retaining the retainer in place, each said retaining means having a first portion attached to an associated one of the ends of the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
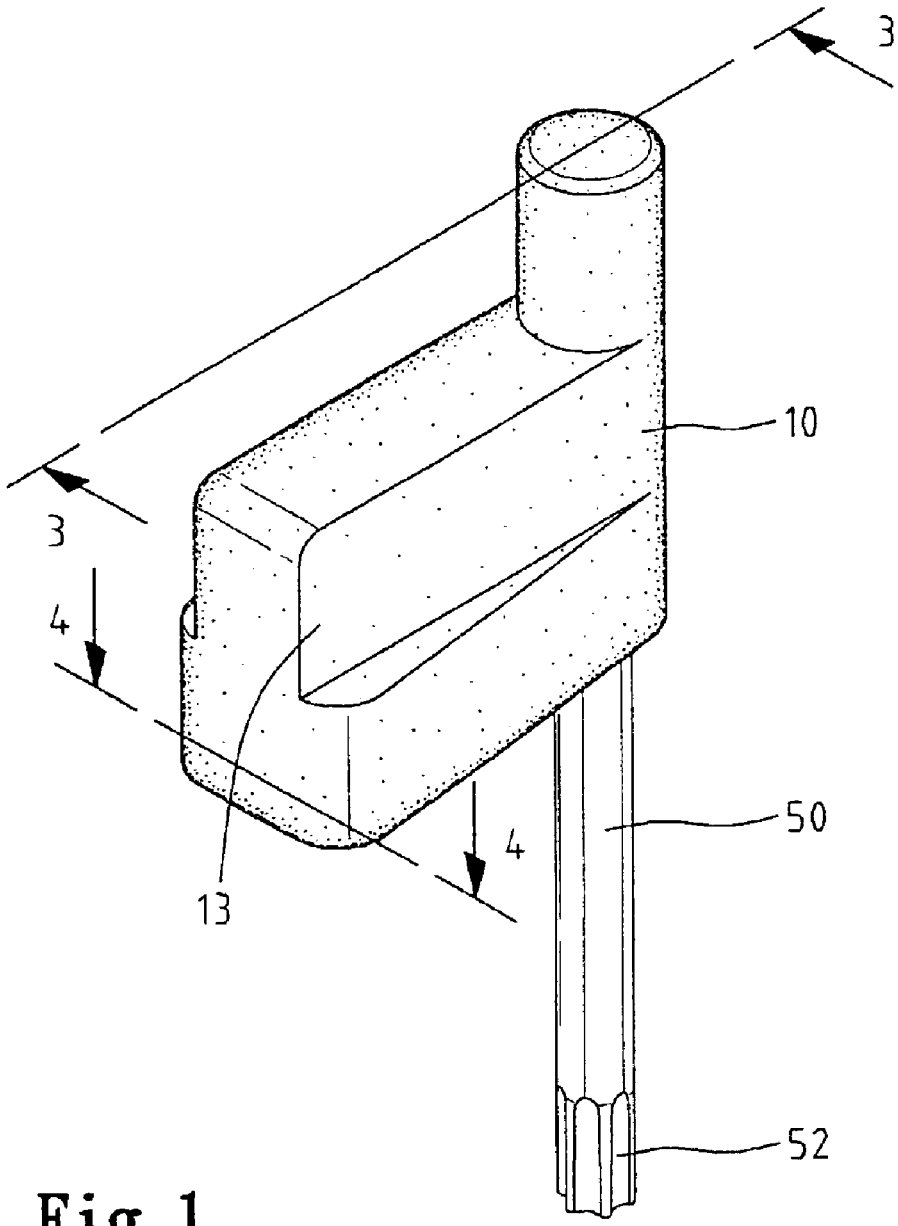
FIG. 1 is a perspective view of a wrench in accordance with the present invention.
Figure 2:
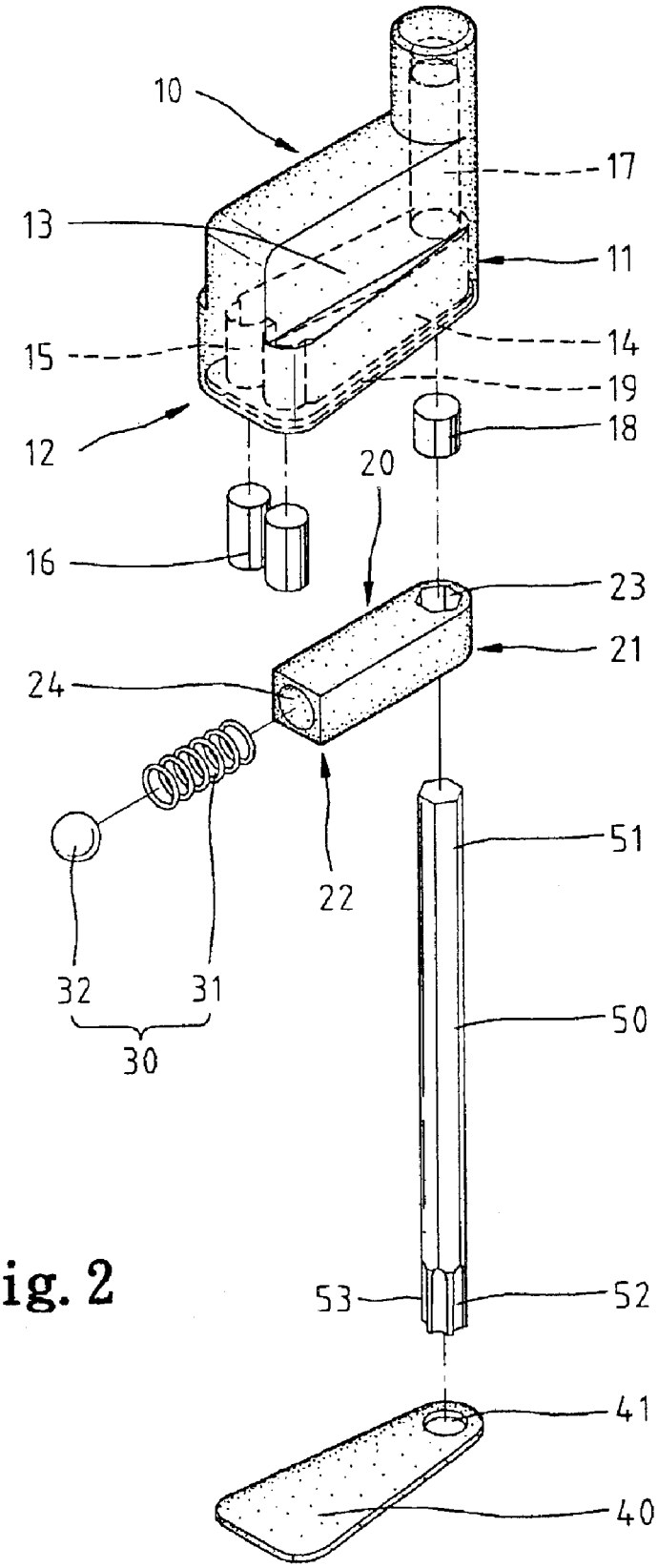
FIG. 2 is an exploded perspective view of the wrench in accordance with the present invention.

Referring to FIGS. 1 and 2, a wrench in accordance with the present invention generally includes a drive member, a retainer 20, and a casing 10. The drive member in this embodiment is a hexagonal rod 50 and has a first end 51 and a second end 52 with a driving portion 53 for engaging with a fastener. In this embodiment, the driving portion 53 is shaped as a TORX type wrench.

The retainer 20 comprises a first end 21 and a second end 22. A transverse through-hole 23 is defined in the first end 21 of the retainer 20 and securely engages with the rod 50 to move therewith. In this embodiment, the transverse through-hole 23 is hexagonal for engaging with the hexagonal rod 50. A receptacle 24 is defined in an end face of the second end 22 of the retainer 20 for receiving a retaining means 30 consisting of an elastic element 31 and a pressing member 32 that is in the form of a ball in this embodiment.

Figure 3:
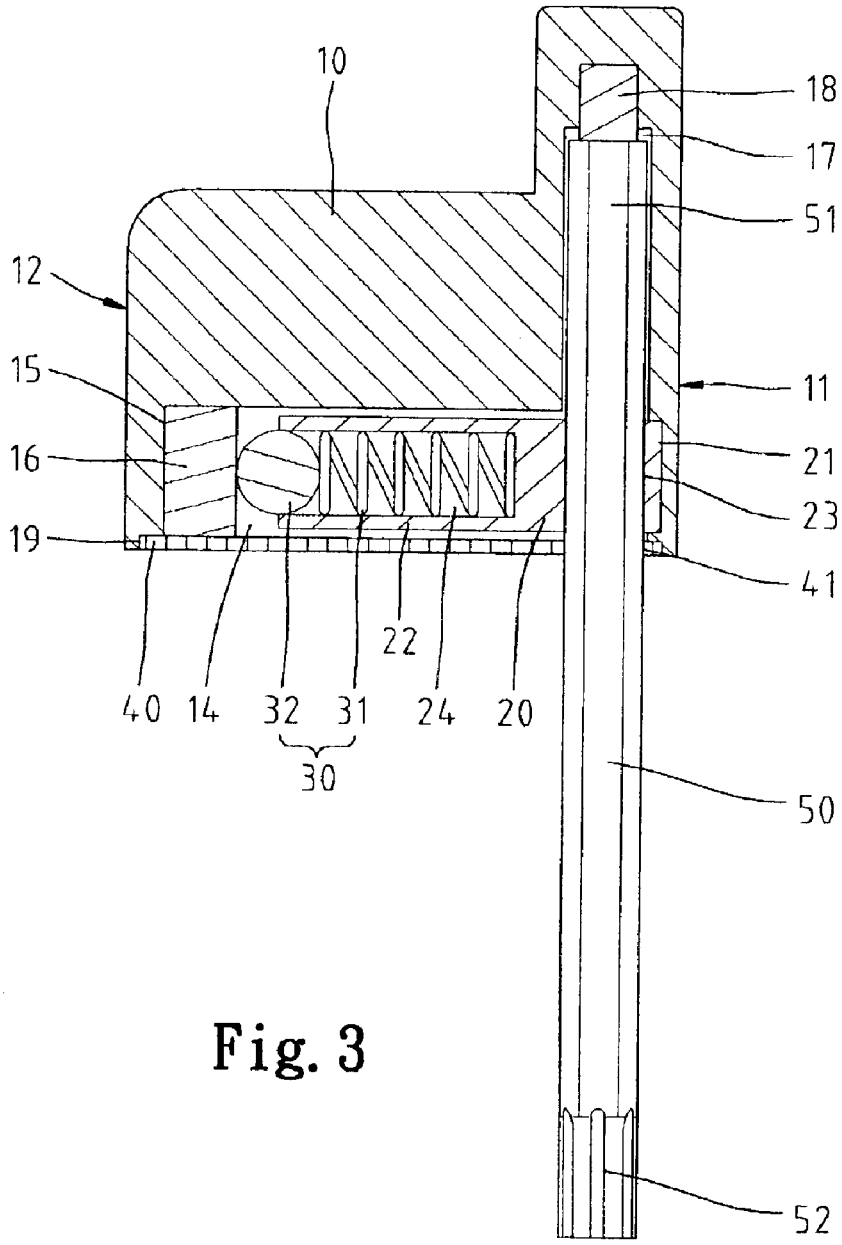
FIG. 3 is a sectional view taken along plane 3—3 in FIG. 1.
Figure 4:
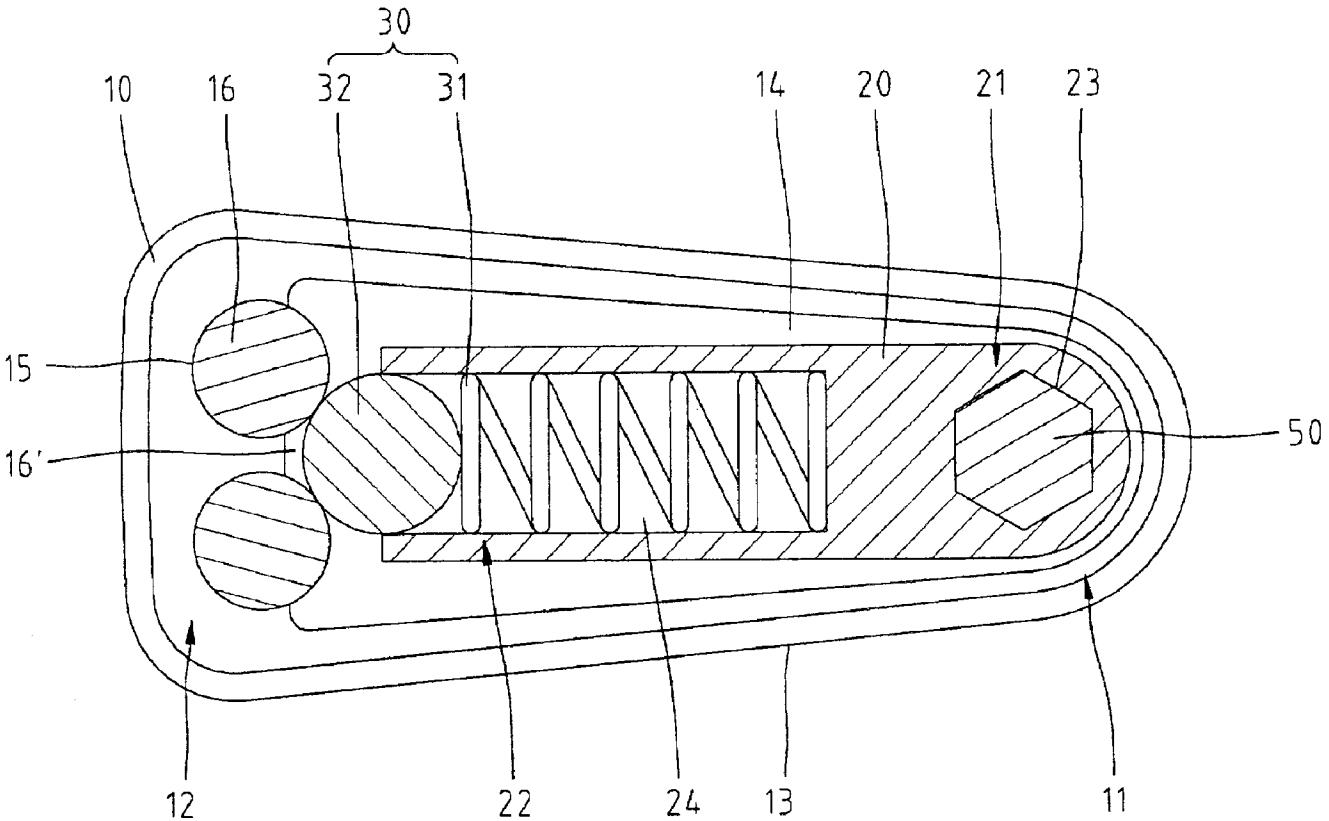
FIG. 4 is a sectional view taken along plane 4—4 in FIG. 1.

The casing 10 comprises a first end 11 and a second end 12. A grip portion 13 is formed on the second end 12 of the casing 10 for manual turning operation. A compartment 14 is defined in the casing 10 for accommodating the retainer 20. As illustrated in FIGS. 3 and 4, a wall delimiting a portion of the compartment 14 and facing the retainer 20 comprises two peg holes 15 each having an opening (not labeled) communicated with the compartment 14. A steel peg 16 is anchored in each peg hole 15. As illustrated in FIG. 4, a portion not greater than a half of each steel peg 16 is exposed in the compartment 14. A retaining space 16' is defined between the exposed portions of the steel pegs 16 that form a retaining section. Normally, the pressing member 32 is biased by the elastic element 31 to enter and thus be retained in the retaining space 16'. In this embodiment, the pressing member 32 presses against the exposed portions of the steel pegs 16 under the action of the elastic element 31.

Referring to FIGS. 2 and 3, a positioning hole 17 is defined in the first end 11 of the casing 10 and communicated with the compartment 14. The first end 51 of the rod 50 is received in the positioning hole 17 of the casing 10, and a magnetic member 18 is mounted in an end of the positioning hole 17 and in contact with the first end 51 of the rod 50 for attracting the rod 50. Thus, the drive member 10 is partially and releasably mounted in the positioning hole 17 of the casing 10. A recessed portion 19 surrounds the compartment 14 of the casing 10, and a lid 40 is mounted in the recessed portion 19 for closing the compartment 14. The lid 40 has a hole 41 through which the rod 50 extends.

Figure 4A:
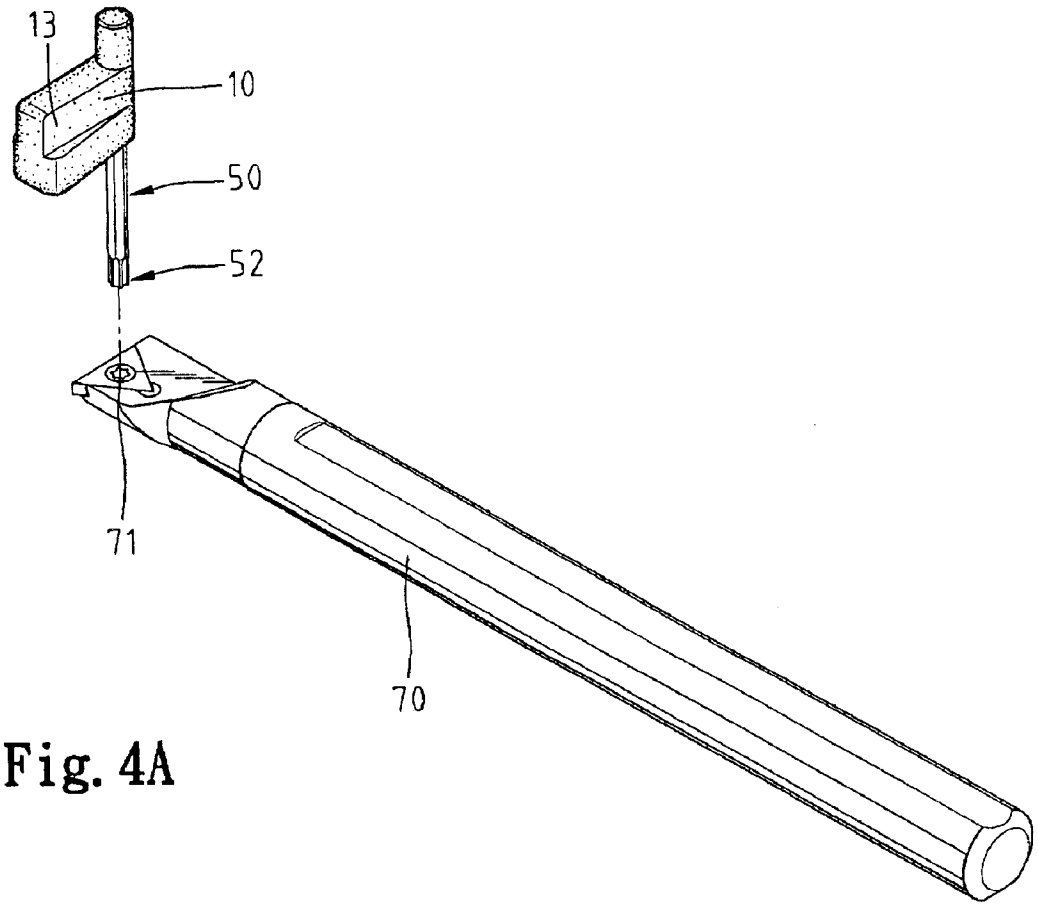
FIG. 4A is a perspective view illustrating use of the wrench in accordance with the present invention.
Figure 5:
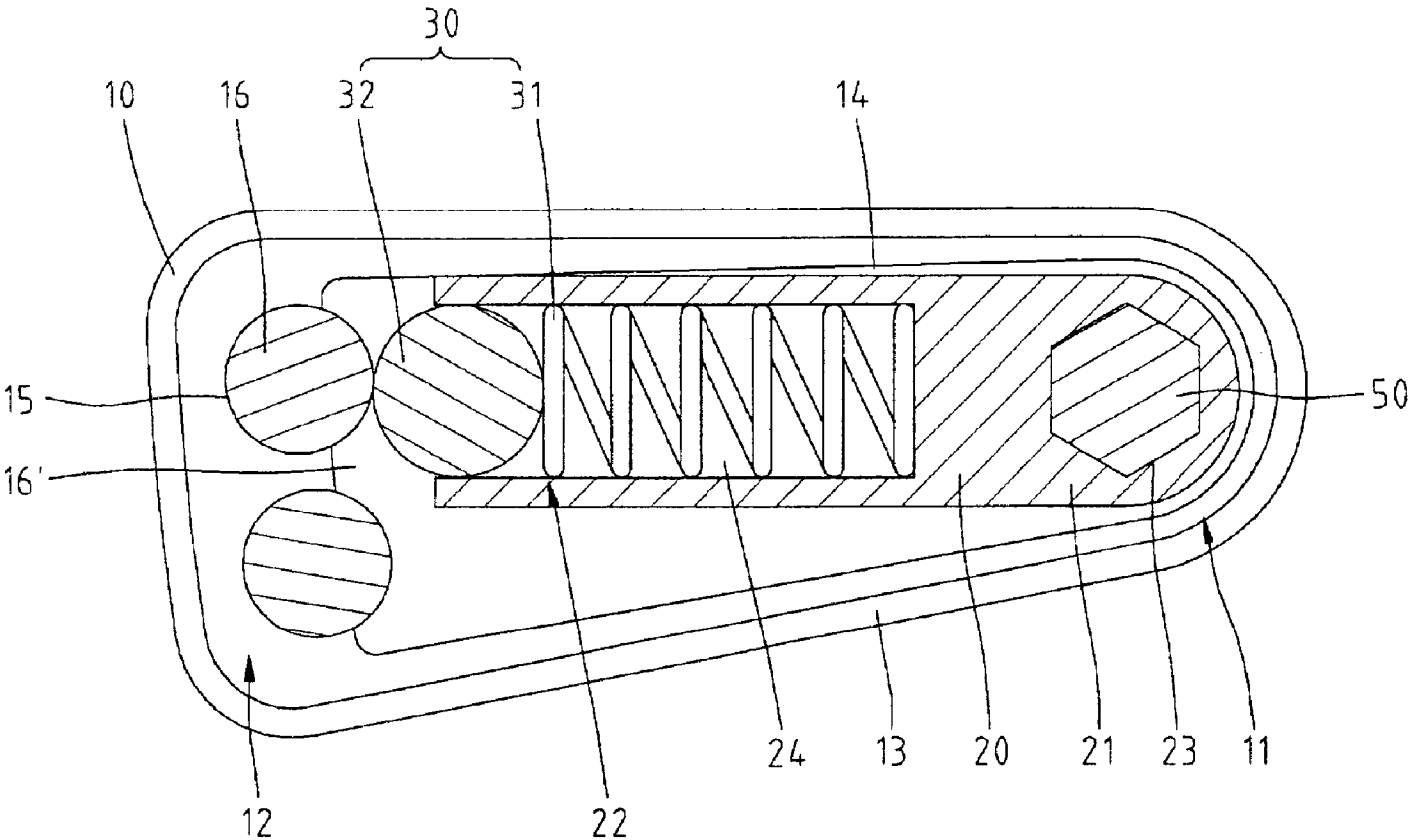
FIG. 5 is a sectional view similar to FIG. 4, illustrating sliding of the wrench in a direction.
Figure 6:
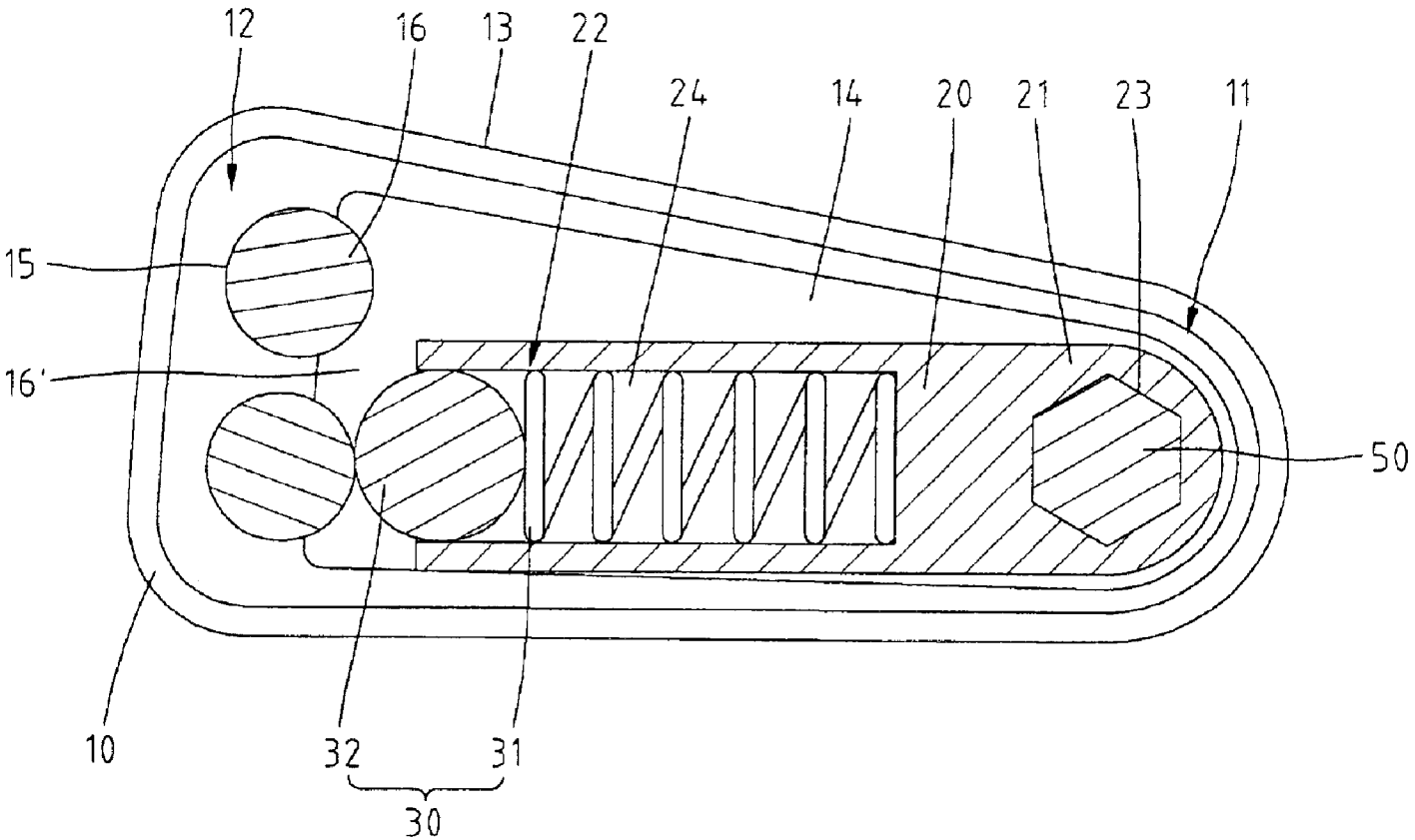
FIG. 6 is a sectional view similar to FIG. 4, illustrating sliding of the wrench in a different direction.

Referring to FIG. 4A, when driving a TORX type bolt 71 for a cutting tool 70, the driving portion 53 of the second end 52 of the rod 50 is engaged with the bolt 71, and the casing 10 is then turned by means of gripping and turning the grip portion 13. Referring to FIG. 4, when the rotational force applied to the wrench is smaller than a predetermined engaging force between the pressing member 32 and the steel pegs 16, the retainer 20 and the rod 50 turn together with the casing 10 to thereby drive the bolt 71. When the rotational force applied to the wrench is greater than the predetermined engaging force between the pressing member 32 and the steel pegs 16, the casing 10 slides relative to the pressing member 32. Thus, the casing 10 is moved to a position shown in FIG. 5 or FIG. 6; namely, the pressing member 32 is disengaged from the retaining space 16', but the retainer 20 and the rod 50 are not turned. As a result, the bolt 71 is not turned. The casing 10 returns to its original position shown in FIG. 4 under the action of the elastic element 31 when the force is released.

It is noted that the engaging force, which largely depends on the elastic coefficient of the elastic element 31, determines the maximum operational torque for turning the retainer 20 and the rod 50. Namely, the retainer 20 and the rod 50 are turned when the torque applied to the casing 10 is smaller than the maximum operational torque, and the retainer 20 and the rod 50 are not turned when the torque applied to the casing 10 is greater than the maximum operational torque. During tightening of the bolt 71, the bolt 71 before being tightened is turned by means of applying a torque smaller than the maximum operational torque. When the bolt 71 is tightened, the torque required to turn the casing 10 would be greater than the maximum operational torque such that the casing 10 slides. Thus, the user will notice the sliding motion of the casing 10 and be aware of tightening of the bolt 71. The maximum operational torque can be altered by means of selecting elastic elements of different elastic coefficients.

Figure 7:
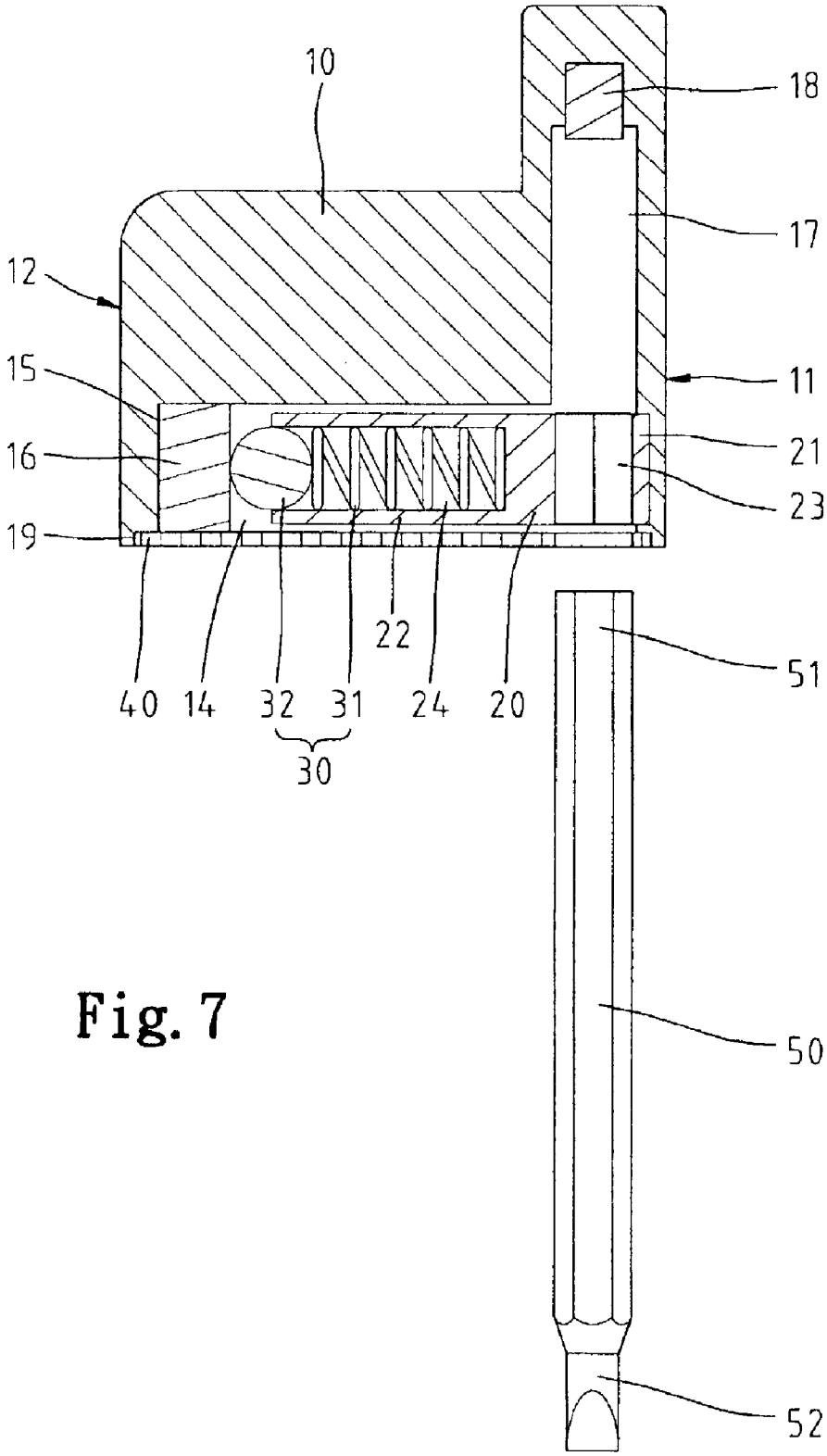
FIG. 7 is a sectional view similar to FIG. 3, illustrating replacement of a drive member of the wrench in accordance with the present invention.

When the fastener is of the type having a slot (not shown), the user may remove the rod 50 from the positioning hole 17 of the casing 10 and insert a drive member 50 of the type having a cabinet tip (see 52 of FIG. 7) into the hexagonal transverse through-hole 23 of the retainer 20 and the positioning hole 17 of the casing 10 until an end of the drive member is in contact with the magnetic member 18. Thus, the wrench in accordance with the present invention can be used with various types of drive members for driving various types of fasteners through simple replacement of the drive member.

Figure 8:
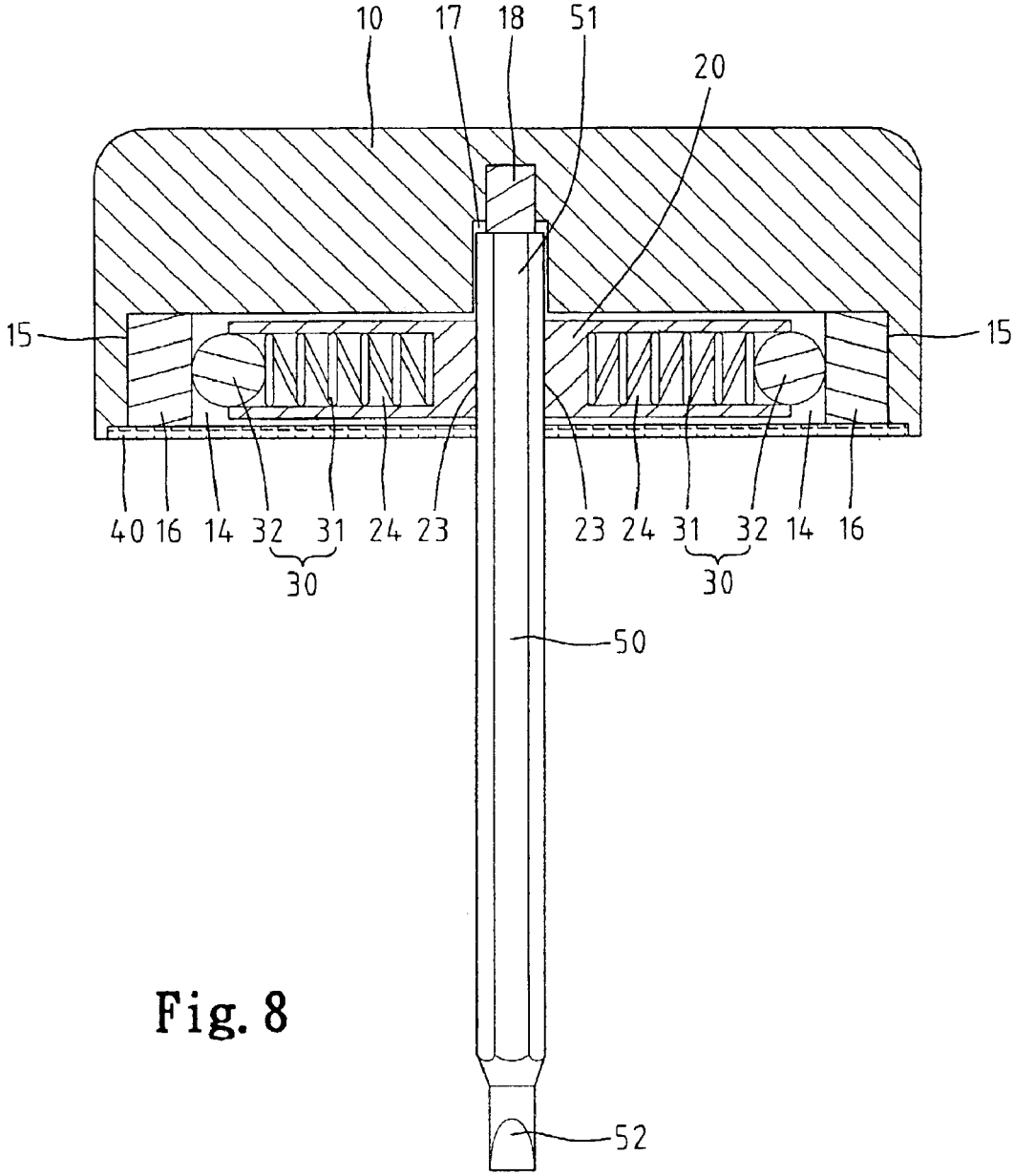
FIG. 8 is a sectional view illustrating a second embodiment of the wrench in accordance with the present invention.

FIG. 8 illustrates a second embodiment of the wrench in accordance with the present invention, wherein the casing 10 is increased in size with the positioning hole 17 defined in a central portion thereof, the retainer 20 is also increased in size with the hexagonal transverse through-hole 23 defined in a central portion thereof, the lid 40 is also increased in size with the hole 41 defined in a central portion thereof, and an additional set of the compartment 13, the peg holes 15, the steel pegs 16, the recess 19, the elastic element 31, and the pressing member 32 is provided in a manner symmetric to the original set of the above elements. Operation of the wrench of this embodiment is substantially the same as that of the first embodiment.

Figure 9:
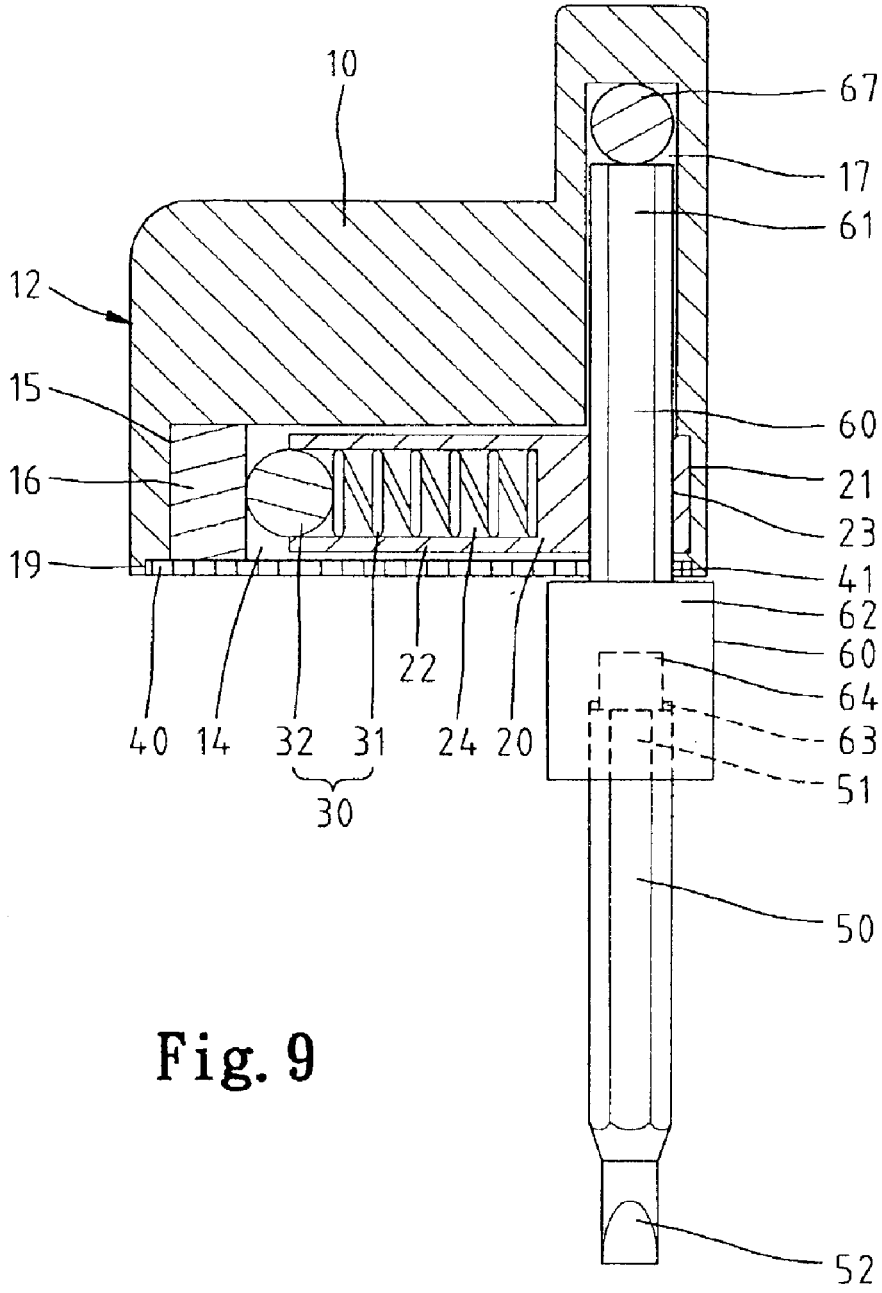
FIG. 9 is a sectional view illustrating a third embodiment of the wrench in accordance with the present invention.

FIG. 9 illustrates a third embodiment of the wrench in accordance with the present invention, wherein the drive member includes a coupling member 60 engaged in the transverse through-hole 23 of the retainer 20, with an end 61 of the coupling member 60 located in the positioning hole 17 of the casing 10 and with the other end 62 of the coupling member 60 located outside the casing 10 and having a coupling hole 63. The drive member further includes a rod 50 having a first end 51 coupled in the coupling hole 63 of the coupling member 60 and a second end 52 for driving fasteners. Further, a magnetic member 64 is fixed in the coupling hole 63 of the coupling member 60 and in contact with the first end 51 of the rod 50 for attracting and thus positioning the rod 50. Further, a ball 67 is provided between an end face delimiting the positioning hole 17 of the casing 10 and an end face of the first end 61 of the coupling member 60 to allow smooth sliding movement between the coupling member 60 and the casing 10.

Figure 10:
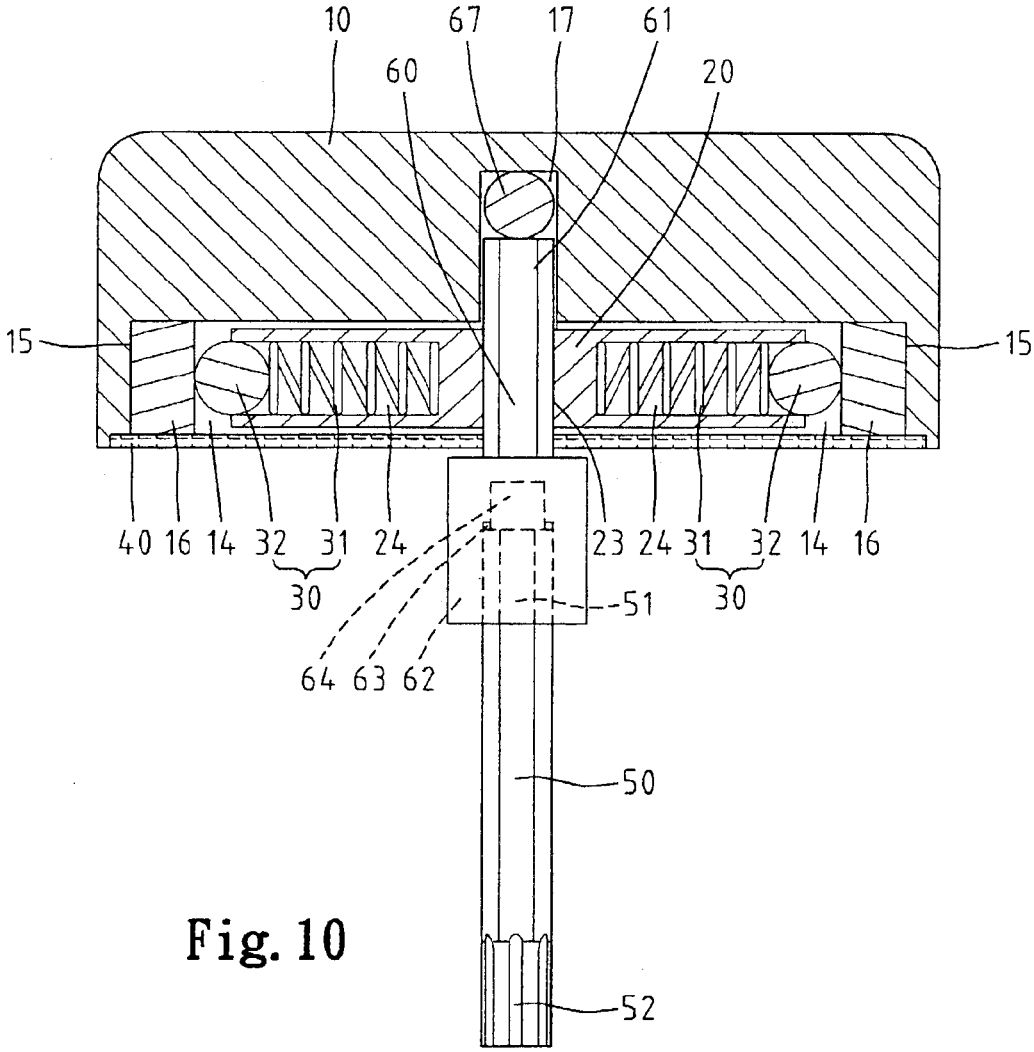
FIG. 10 is a sectional view illustrating a fourth embodiment of the wrench in accordance with the present invention.

FIG. 10 illustrates a fourth embodiment of the wrench in accordance with the present invention that is modified from the second embodiment, wherein the casing 10 is increased in size with the positioning hole 17 defined in a central portion thereof, the retainer 20 is also increased in size with the hexagonal transverse through-hole 23 defined in a central portion thereof, the lid 40 is also increased in size with the hole 41 defined in a central portion thereof, and an additional set of the compartment 13, the peg holes 15, the steel pegs 16, the recess 19, the elastic element 31, and the pressing member 32 is provided in a manner symmetric to the original set of the above elements. Operation of the wrench of this embodiment is substantially the same as that of the second embodiment.

Figure 11:
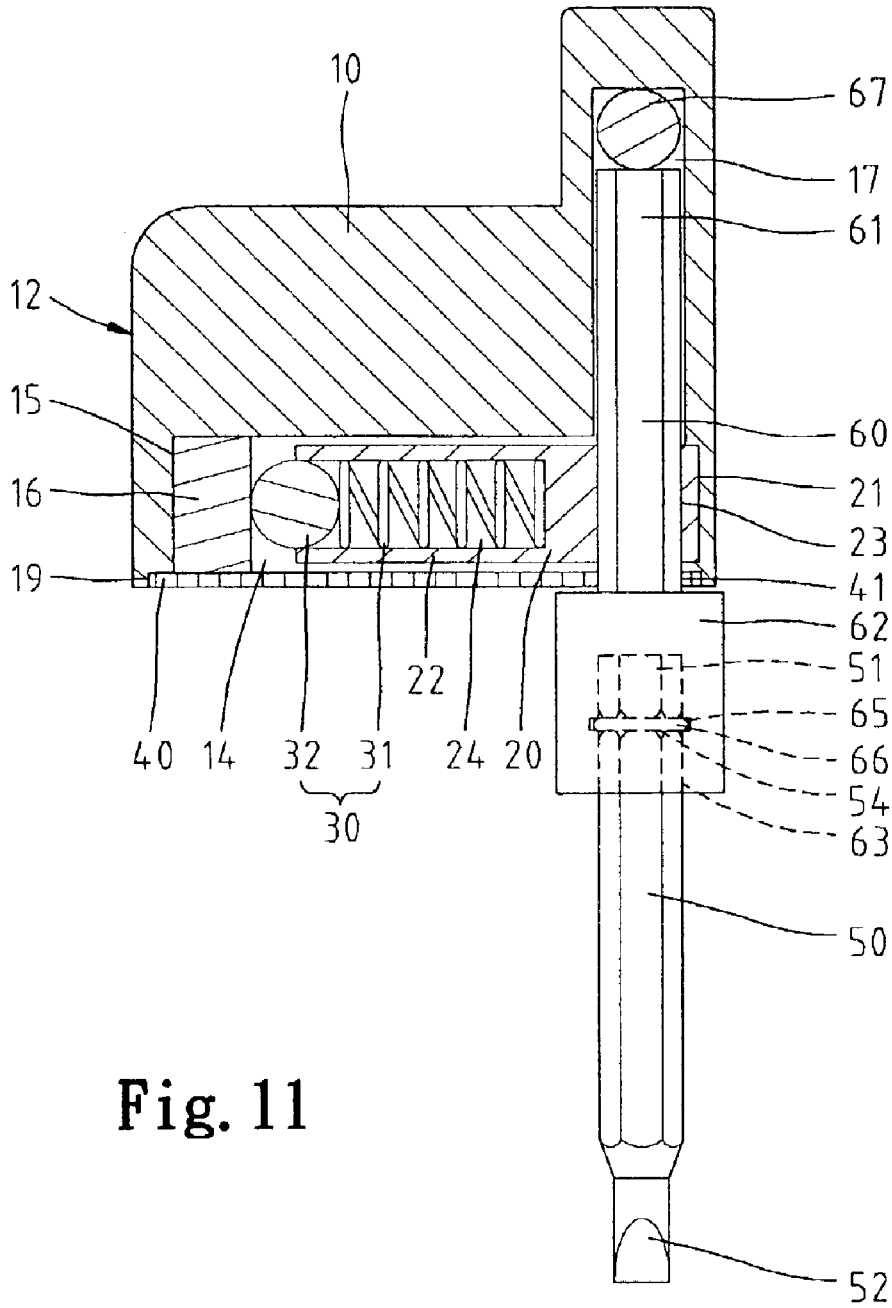
FIG. 11 is a sectional view illustrating a fifth embodiment of the wrench in accordance with the present invention.

FIG. 11 illustrates a fifth embodiment of the wrench in accordance with the present invention that is modified from the third embodiment, wherein the magnetic member 64 of the second embodiment shown in FIG. 9 is omitted. Further, an annular groove 65 is defined in a peripheral wall delimiting the coupling hole 63 of the coupling member 60, and a C-clip 66 is received in the annular groove 65 for releasably retaining the first end 51 of the rod 50 in place. It is noted that the first end 51 of the rod 50 has an annular groove 54 for partially receiving the C-clip 66.

Figure 12:
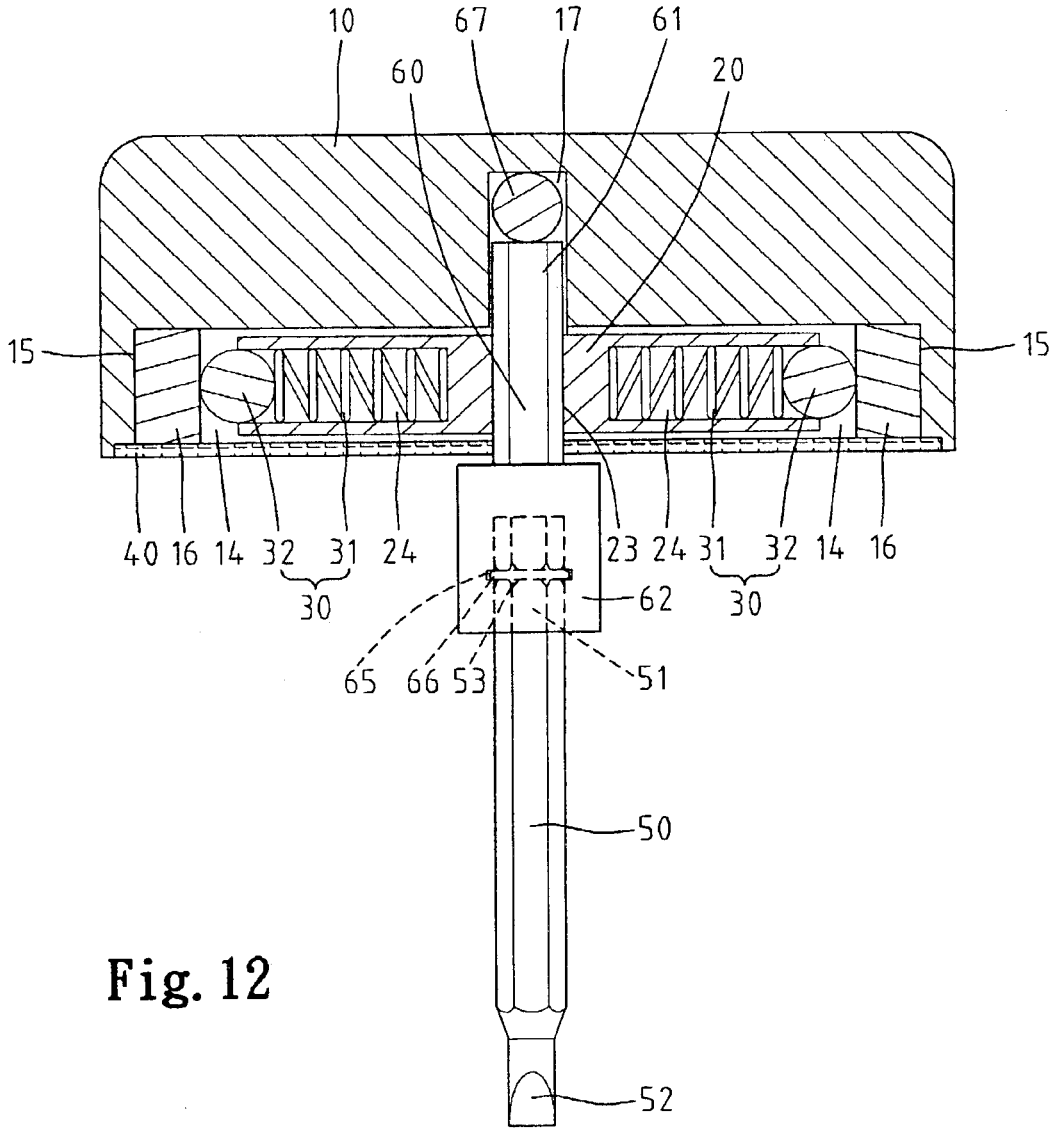
FIG. 12 is a sectional view illustrating a sixth embodiment of the wrench in accordance with the present invention.
Figure 13:
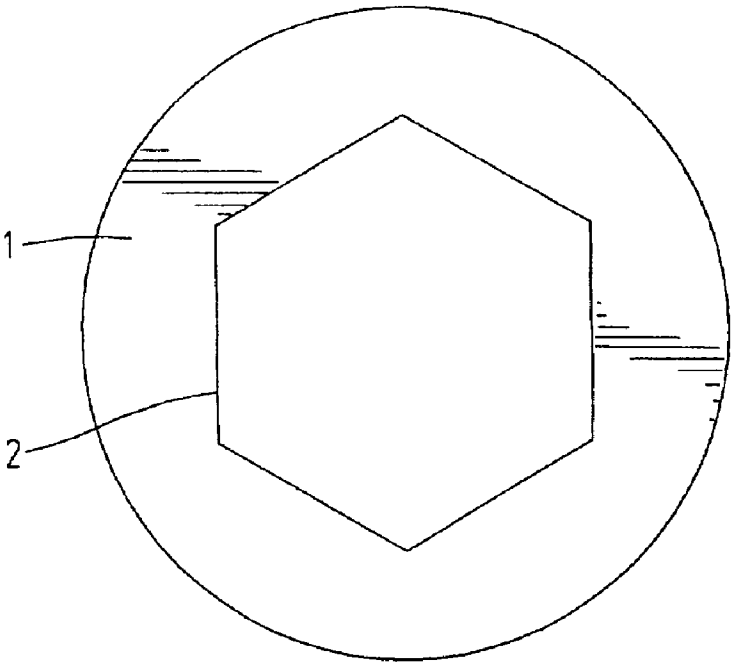
Fig. 13 PRIOR ART
FIG. 13 is an end view of a conventional hexagonal wrench.
Figure 14:
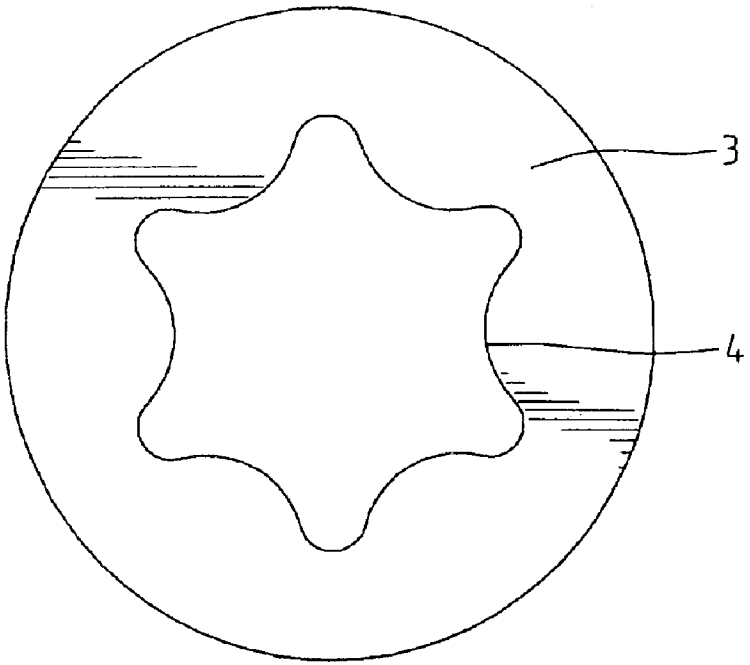
Fig. 14 PRIOR ART
FIG. 14 is an end view of a conventional TORX wrench.
Figure 15:
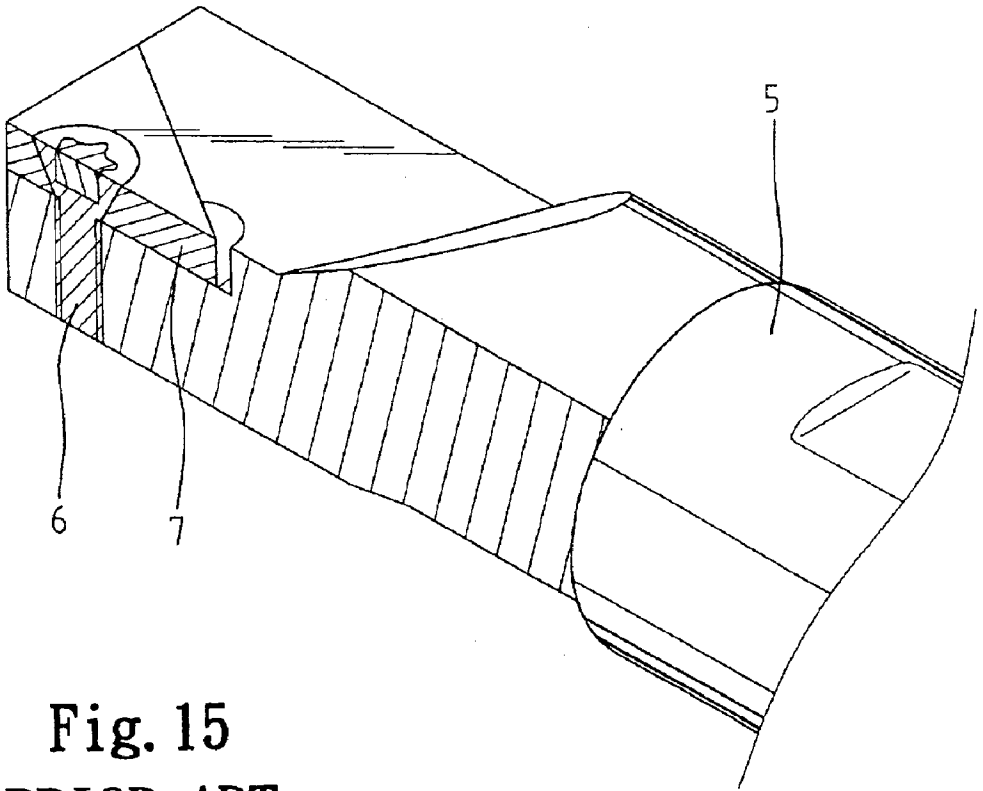
Fig. 15 PRIOR ART
FIG. 15 is a perspective view, partly cutaway, of a cutting tool.

FIG. 12 illustrates a sixth embodiment of the wrench in accordance with the present invention that is modified from the fifth embodiment, wherein the casing 10 is increased in size with the positioning hole 17 defined in a central portion thereof, the retainer 20 is also increased in size with the hexagonal transverse through-hole 23 defined in a central portion thereof, the lid 40 is also increased in size with the hole 41 defined in a central portion thereof, and an additional set of the compartment 13, the peg holes 15, the steel pegs 16, the recess 19, the elastic element 31, and the pressing member 32 is provided in a manner symmetric to the original set of the above elements. Operation of the wrench of this embodiment is substantially the same as that of the fourth embodiment.

The wrench in accordance with the present invention can be used with various types of drive members for driving various types of fasteners through simple replacement of the drive member. Further, the maximum operational torque can be altered by means of selecting elastic elements of different elastic coefficients. Thus, a stable maximum operational torque is provided, as the structure of the wrench in accordance with the present invention is simpler than the conventional wrenches, and the overall cost for the wrench in accordance with the present invention is lower that for conventional wrenches. Further, the wrench in accordance with the present invention can be used in limited spaces, as the overall size of the wrench is relatively small.

Although the invention has been explained in relation to its preferred embodiment, it is to be understood that many other possible modifications and variations can be made without departing from the scope of the invention as hereinafter claimed.

What is claimed is:

1. A wrench comprising:

a casing including a compartment, the casing further including a retaining section defining a retaining space;

a retainer pivotably received in the compartment of the casing and having a first end and a second end;

a drive member releasably and securely engaged with the retainer to move therewith, the drive member having a driving portion on an end thereof that is located outside the casing for engaging with a fastener; and retaining means for retaining the retainer in place, the retaining means having a first portion attached to the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

2. The wrench as claimed in claim 1, wherein the first end of the retainer includes a hexagonal transverse through-hole and the drive member is a hexagonal rod extending through the hexagonal hole of the retainer, with the first portion of the retaining means being attached to the second end of the retainer.

3. The wrench as claimed in claim 2, wherein the casing includes a positioning hole communicated with the compartment, with another end of the hexagonal rod being received in the positioning hole, with a magnetic member being fixed in the positioning hole for attracting and positioning the hexagonal rod.

4. The wrench as claimed in claim 2, wherein a wall delimiting a portion of the compartment of the casing includes two peg holes each having a peg anchored therein, each said peg being partially exposed in the compartment to thereby define the retaining space between the exposed portions of the pegs.

5. The wrench as claimed in claim 4, wherein the second end of the retainer includes a receptacle, the retaining means including an elastic element and a pressing member mounted in the receptacle, the pressing member being biased by the elastic element to press against the exposed portions of the pegs.

6. The wrench as claimed in claim 1, wherein the drive member includes a coupling member securely engaged with the retainer to move therewith, the coupling member having an end located outside the casing, the drive member further including a rod having a first end releasably engaged with the end of the coupling member and a second end on which the driving portion is formed.

7. The wrench as claimed in claim 6, wherein the end of the coupling member includes a coupling hole, further including a magnetic member fixed in the coupling hole for attracting and positioning the rod.

8. The wrench as claimed in claim 7, wherein a wall delimiting a portion of the compartment of the casing includes two peg holes each having a peg anchored therein, each said peg being partially exposed in the compartment to thereby define the retaining space between the exposed portions of the pegs.

9. The wrench as claimed in claim 8, wherein the second end of the retainer includes a receptacle, the retaining means including an elastic element and a pressing member mounted in the receptacle, the pressing member being biased by the elastic element to press against the exposed portions of the pegs.

10. The wrench as claimed in claim 6, wherein the end of the coupling member includes a coupling hole, a peripheral wall delimiting the coupling hole having an annular groove, further including a C-clip received in the annular groove for releasably holding an end of the rod having an annular groove.

11. The wrench as claimed in claim 10, wherein a wall defining a portion of the compartment of the casing includes two peg holes each having a peg anchored therein, each said peg being partially exposed in the compartment to thereby define the retaining space between the exposed portions of the pegs.

12. The wrench as claimed in claim 11, wherein the second end of the retainer includes a receptacle, the retaining means including an elastic element and a pressing member mounted in the receptacle, the pressing member being biased by the elastic element to press against the exposed portions of the pegs.

13. The wrench as claimed in claim 1, wherein the retainer includes a hexagonal transverse through-hole in a central portion thereof, the drive member is a hexagonal rod extending through the hexagonal transverse through-hole of the retainer.

14. The wrench as claimed in claim 13, wherein the casing includes a positioning hole communicated with the compartment, with another end of the hexagonal rod being received in the positioning hole, with magnetic member being fixed in the positioning hole for attracting and positioning the hexagonal rod.

15. The wrench as claimed in claim 13, wherein each of two end walls respectively delimiting two ends of the compartment of the casing includes two peg holes each having a peg anchored therein, each said peg in each said end of the compartment being partially exposed in the compartment to thereby define the retaining space between the exposed portions of the pegs.

16. The wrench as claimed in claim 15, wherein each of the first end and the second end of the retainer includes a receptacle, the retaining means including an elastic element and a pressing member mounted in each said receptacle, with the pressing member being biased by the elastic element to press against the exposed portions of the pegs.

17. The wrench as claimed in claim 7, wherein the retainer includes a hexagonal transverse through-hole in a central portion thereof, the drive member is a hexagonal rod extending through the hexagonal transverse through-hole of the retainer, each of two end walls respectively delimiting two ends of the compartment of the casing including two peg holes each having a peg anchored therein, each said peg in each said end of the compartment being partially exposed in the compartment to thereby define the retaining space between the exposed portions of the pegs, each of the first end and the second end of the retainer including a receptacle, the retaining means including an elastic element and a pressing member mounted in each said receptacle, with the pressing member being biased by the elastic element to press against the exposed portions of the pegs.

18. The wrench as claimed in claim 10, wherein the retainer includes a hexagonal transverse through-hole in a central portion thereof, the drive member is a hexagonal rod extending through the hexagonal transverse through-hole of the retainer, each of two end walls respectively delimiting two ends of the compartment of the casing including two peg holes each having a peg anchored therein, each said peg being partially exposed in the compartment to thereby define the retaining space between the exposed portions of the pegs, each of the first end and the second end of the retainer including a receptacle, the retaining means including an elastic element and a pressing member mounted in each said receptacle, with the pressing member being biased by the elastic element to press against the exposed portions of the pegs.

19. A wrench comprising:

a casing including a compartment, the casing further including a retaining section defining a retaining space;

a retainer received in the compartment of the casing and having a first end and a second end, the retainer being pivotally movable in the compartment about the first end of the retainer;

a drive member securely engaged with the retainer to move therewith, the drive member having a driving portion on an end thereof that is located outside the casing for engaging with a fastener, the drive member being disengageable from the retainer by means of directly pulling the drive member away from the casing along a longitudinal axis of the drive member; and a retaining means for retaining the retainer in place, the retaining means having a first portion attached to the second portion of the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

20. A wrench comprising:

a casing including a compartment, the casing further including a retaining section defining a retaining space;

a retainer received in the compartment of the casing and having two ends, the retainer being pivotally movable in the compartment about a center of the retainer;

a drive member securely engaged with the retainer to move therewith, the drive member having a driving portion on an end thereof that is located outside the casing for engaging with a fastener, the drive member being disengageable from the retainer by means of directly pulling the drive member away from the casing along a longitudinal axis of the drive member; and two retaining means for retaining the retainer in place, each said retaining means having a first portion attached to an associated one of the ends of the retainer and a second portion retained in the retaining space;

wherein when a rotational force applied to the casing is smaller than an engaging force between the retaining section of the casing and the second portion of the retaining means, the retainer and the drive member are turned to thereby turn the fastener, with the second portion of the retaining means being retained in the retaining space; and wherein when a rotational force applied to the casing is greater than the engaging force between the retaining section of the casing and the second portion of the retaining means, the casing slides while the retainer and the drive member are not turned, with the second portion of the retaining means disengaging from the retaining space.

* * * * *